US012114734B2

(12) United States Patent
Iuchi et al.

(10) Patent No.: US 12,114,734 B2
(45) Date of Patent: Oct. 15, 2024

(54) SHOE SOLE

(71) Applicant: Shimano Inc., Osaka (JP)

(72) Inventors: Kadunori Iuchi, Osaka (JP); Junichi Kikuta, Osaka (JP); Toshiaki Aoki, Osaka (JP)

(73) Assignee: Shimano Inc., Osaka (JP)

( * ) Notice: Subject to any disclaimer, the term of this patent is extended or adjusted under 35 U.S.C. 154(b) by 137 days.

(21) Appl. No.: 17/747,437

(22) Filed: May 18, 2022

(65) Prior Publication Data

US 2023/0371656 A1 Nov. 23, 2023

(51) Int. Cl.

| | |
|---|---|
| ***A43B 13/14*** | (2006.01) |
| ***A43B 5/14*** | (2006.01) |
| ***A43B 13/12*** | (2006.01) |
| ***A43C 15/16*** | (2006.01) |

(52) U.S. Cl.

CPC ..... *A43C 15/161* (2013.01); *A43B 5/14* (2013.01); *A43B 13/122* (2013.01); *A43B 13/125* (2013.01); *A43B 13/14* (2013.01); *A43B 13/141* (2013.01)

(58) Field of Classification Search

CPC ..... A43B 13/141; A43B 5/14
USPC ..... 36/102, 131
See application file for complete search history.

(56) References Cited

U.S. PATENT DOCUMENTS

| | | | | |
|---|---|---|---|---|
| 5,915,820 | A * | 6/1999 | Kraeuter | A43B 7/144 36/102 |
| 6,438,873 | B1 * | 8/2002 | Gebhard | A43C 1/04 36/31 |
| 9,894,958 | B2 * | 2/2018 | Cheney | A43B 9/00 |
| 11,272,756 | B2 | 3/2022 | Torrance | |
| 2004/0111920 | A1 * | 6/2004 | Cretinon | A43B 13/141 36/30 R |
| 2008/0289220 | A1 * | 11/2008 | Rivas | A43B 13/141 36/35 R |
| 2011/0088287 | A1 * | 4/2011 | Auger | A43B 13/125 36/114 |
| 2014/0259796 | A1 * | 9/2014 | Hillyer | A43B 5/14 36/134 |
| 2017/0035143 | A1 * | 2/2017 | Sato | A43B 7/148 |
| 2021/0259357 | A1 | 8/2021 | Paterson et al. | |
| 2021/0267304 | A1 | 9/2021 | Farris et al. | |
| 2022/0022595 | A1 * | 1/2022 | Girard | A43B 13/183 |
| 2022/0039510 | A1 * | 2/2022 | Winefordner | A43B 13/14 |
| 2022/0378145 | A1 * | 12/2022 | Tateno | A43B 13/125 |
| 2023/0329390 | A1 * | 10/2023 | Dewart | A43B 23/028 |

FOREIGN PATENT DOCUMENTS

| | | | | |
|---|---|---|---|---|
| WO | WO-9610346 | A1 * | 4/1996 | A43B 5/14 |
| WO | WO-2022040629 | A1 * | 2/2022 | A43B 13/125 |

* cited by examiner

*Primary Examiner* — Ted Kavanaugh

(74) *Attorney, Agent, or Firm* — Global IP Counselors, LLP

(57) ABSTRACT

A shoe sole includes a first sole layer including a first region having a first rigidity, and a second region extending in a longitudinal direction of the shoe sole. The second region is spaced from a toe edge of the first sole layer and is spaced from a heel edge of the first sole layer. The first sole layer has a cleat engagement part. The second region is located between the cleat engagement part and a side edge of the first sole layer.

21 Claims, 16 Drawing Sheets

SHOE SOLE

BACKGROUND

Technical Field

This disclosure generally relates to a shoe sole for a shoe provided with the shoe sole.

Background Information

Generally, most shoes have an upper and a sole. The upper is stitched or adhesively bonded to the sole to form an interior foot receiving space for securely receiving a foot. The upper is typically formed from one or more flexible materials such as a textile fabric, a leather, and/or a synthetic leather that are stitched or adhesively bonded together. The upper can also include rigid reinforcements as needed and/or desired. The upper defines an ankle opening for inserting the wearer's foot into the interior foot receiving space and for removing wearer's foot from the interior foot receiving space. In addition, the upper can include a lace or other closure to more securely retain the shoe to the wearer's foot within the interior foot receiving space. The sole can be a single layer made of a suitable material, or can be made of several layers of different materials. In the case of many athletic shoes, the sole generally has an insole, a midsole and an outsole. The insole can define the bottom surface of the interior foot receiving space. The insole may be a thin compressible member that enhances the comfort of the shoe. The midsole is typically attached to the lower edge of the upper. The midsole is often a middle layer of the sole. The outsole is typically secured to a lower surface of the midsole, and forms a ground-contacting portion of the shoe.

SUMMARY

Generally, the present disclosure is directed to various features of a shoe sole that can increase the contact area between the shoe sole and a surface when the shoe sole contacts the surface at an oblique angle.

In view of the state of the known technology and in accordance with a first aspect of the present disclosure, a shoe sole is provided that basically comprises a first sole layer including a first region having a first rigidity, and a second region having a second rigidity that is more flexible than the first rigidity and extending in a longitudinal direction of the shoe sole. The second region is spaced from a toe edge of the first sole layer. The second region is spaced from a heel edge of the first sole layer. The first sole layer has a cleat engagement part. The second region is located between the cleat engagement part and a side edge of the first sole layer.

With the shoe sole according to the first aspect, it is possible to reduce rigidity in a width direction of the shoe sole while maintaining rigidity in a longitudinal direction of the shoe sole.

In accordance with a second aspect of the present disclosure, the shoe sole according to the first aspect is configured so that the second region includes at least one elongated through opening.

With the shoe sole according to the second aspect, the stiffness in the width direction of the shoe sole can be easily reduced using at least one elongated through opening.

In accordance with a third aspect of the present disclosure, the shoe sole according to the first aspect or the second aspect is configured so that the second region extends to a stepping part of the shoe sole in the longitudinal direction of the shoe sole.

With the shoe sole according to the third aspect, the stiffness in the width direction of the shoe sole can be easily reduced in the stepping part of the shoe sole.

In accordance with a fourth aspect of the present disclosure, the shoe sole according to any one of the first aspect to the third aspect is configured so that the first sole layer is disposed adjacent to an upper of a shoe in a state where the shoe sole is coupled to the upper.

With the shoe sole according to the fourth aspect, the first sole layer can reliably deform when obliquely stepping on an inclined surface while maintaining rigidity in a longitudinal direction of the shoe sole.

In accordance with a fifth aspect of the present disclosure, the shoe sole according to any one of the first aspect to the fourth aspect is configured so the second region includes a first part and a second part, the first part is located on an inner instep side of the cleat engagement part. The second part is located on an outer instep side of the cleat engagement part.

With the shoe sole according to the fifth aspect, it is possible to different rigidity on the inner instep side of the first sole layer of relative to the rigidity on outer instep side of the first sole layer.

In accordance with a sixth aspect of the present disclosure, the shoe sole according to the fifth aspect is configured so that the second part is longer than the first part.

With the shoe sole according to the sixth aspect, the operability of the outer instep side of the first sole layer is enhanced.

In accordance with a seventh aspect of the present disclosure, the shoe sole according to the fifth aspect is configured so that the first part includes a first elongated through opening. The second part includes a second elongated through opening that is longer than the first elongated through opening.

With the shoe sole according to the seventh aspect, the operability of the outer instep side of the first sole layer is easily enhanced by the second elongated through opening being longer than the first elongated through opening.

In accordance with an eighth aspect of the present disclosure, the shoe sole according to the fifth aspect further comprises a second sole layer at least partly overlapping the first sole layer. The second sole layer having a third rigidity that is more flexible than the first rigidity.

With the shoe sole according to the eighth aspect, the second sole layer can overlap the bottom surface of the first sole layer without restricting the stiffness in the width direction of the shoe sole.

In accordance with a ninth aspect of the present disclosure, the shoe sole according to the eighth aspect is configured so that the first sole layer is disposed closer to a top of the shoe sole than the second sole layer in a state where shoe sole is assembled.

With the shoe sole according to the ninth aspect, the first sole layer can reliably deform when obliquely stepping on a surface while maintaining rigidity in a longitudinal direction of the shoe sole.

In accordance with a tenth aspect of the present disclosure, the shoe sole according to the eighth aspect further comprises a third sole layer having an outer foot shape, and having a fourth rigidity that is less rigid than the first rigidity.

With the shoe sole according to the tenth aspect, the third sole layer can provide additional features for the shoe sole without restricting the stiffness in the width direction of the shoe sole.

In accordance with an eleventh aspect of the present disclosure, the shoe sole according to the tenth aspect is configured so that the second sole layer is disposed between the first sole layer and the third sole layer.

With the shoe sole according to the eleventh aspect, the third sole layer can protect the second sole layer, In accordance with a twelfth aspect of the present disclosure, the shoe sole according to the tenth aspect is configured so that the third sole layer includes reduced thickness areas at least partially covering the first part and the second part.

With the shoe sole according to the twelfth aspect, the reduced stiffness in the width direction of the shoe sole can be reliably attained while have the third sole layer.

In accordance with a thirteenth aspect of the present disclosure, the shoe sole according to the eleventh aspect or the twelfth aspect is configured so each of the first part and the second part includes at least one first elongated through opening, and the third sole layer includes at least one opening aligned with the at least one elongated through opening of each of the first part and the second part.

With the shoe sole according to the thirteenth aspect, the reduced stiffness in the width direction of the shoe sole can be reliably attained while have the third sole layer.

In accordance with a fourteenth aspect of the present disclosure, the shoe sole according to the thirteenth aspect is configured so that the first part includes a first elongated through opening, the second part includes a second elongated through opening. the first part further includes a third elongated through opening, and the second part further includes a fourth elongated through opening.

With the shoe sole according to the fourteenth aspect, the reduced stiffness in the width direction of the shoe sole can be reliably attained by providing the first elongated through opening and the third elongated through opening on an inner instep side of the cleat engagement part, and providing the second elongated through opening and the fourth elongated through opening on an outer instep side of the cleat engagement part.

In accordance with a fifteenth aspect of the present disclosure, the shoe sole according to any one of the first aspect to the fourteenth aspect is configured so that the cleat engagement part includes at least two attachment openings.

With the shoe sole according to the fifteenth aspect, it is possible to easily attach a cleat to the first sole layer using a pair of fasteners.

In accordance with a sixteenth aspect of the present disclosure, the shoe sole according to any one of the first aspect to the fifteenth aspect further comprises a second sole layer at least partly overlapping the first sole layer. The first sole layer has a first flexibility. The second sole layer has a second flexibility that is more flexible than the first flexibility.

With the shoe sole according to the sixteenth aspect, the second sole layer can overlap the bottom surface of the first sole layer to provide additional features without restricting the stiffness in the width direction of the shoe sole.

In accordance with a seventeenth aspect of the present disclosure, the shoe sole according to any one of the first aspect to the sixteenth aspect further comprises a second sole layer at least partly overlapping the first sole layer. The first sole layer includes a first material. The second sole layer includes a second material different from the first material.

With the shoe sole according to the seventeenth aspect, the second sole layer can overlap the bottom surface of the first sole layer to provide additional features without restricting the stiffness in the width direction of the shoe sole.

In accordance with an eighteenth aspect of the present disclosure, the shoe sole according to the seventeenth aspect is configured so that the first material includes a plastic material.

With the shoe sole according to the eighteenth aspect, it is possible to easily regulate the rigidity of the first sole layer by using a plastic material.

In accordance with a nineteenth aspect of the present disclosure, the shoe sole according to the seventeenth aspect or the eighteenth aspect is configured so that the second material includes an elastic material.

With the shoe sole according to the nineteenth aspect, an amount of downward deformation of the shoe sole can be easily regulated based on the hardness of the elastic material that is used.

In accordance with a twentieth aspect of the present disclosure, a shoe comprises the shoe sole according to any one of the first aspect to the nineteenth aspect, and further comprises an upper attached to the shoe sole.

With the shoe sole according to the nineteenth aspect, it is possible to provide a shoe that is that can appropriately deform in a width direction of the shoe sole while maintaining rigidity in a longitudinal direction of the shoe sole.

Also, other objects, features, aspects and advantages of the disclosed shoe sole will become apparent to those skilled in the shoe field from the following detailed description, which taken in conjunction with the annexed drawings, discloses preferred embodiments of the shoe sole.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the shoe field from this disclosure that the following descriptions of the embodiments are provided for illustration only and not for the purpose of limiting the invention as defined by the appended claims and their equivalents.

Figure 1:
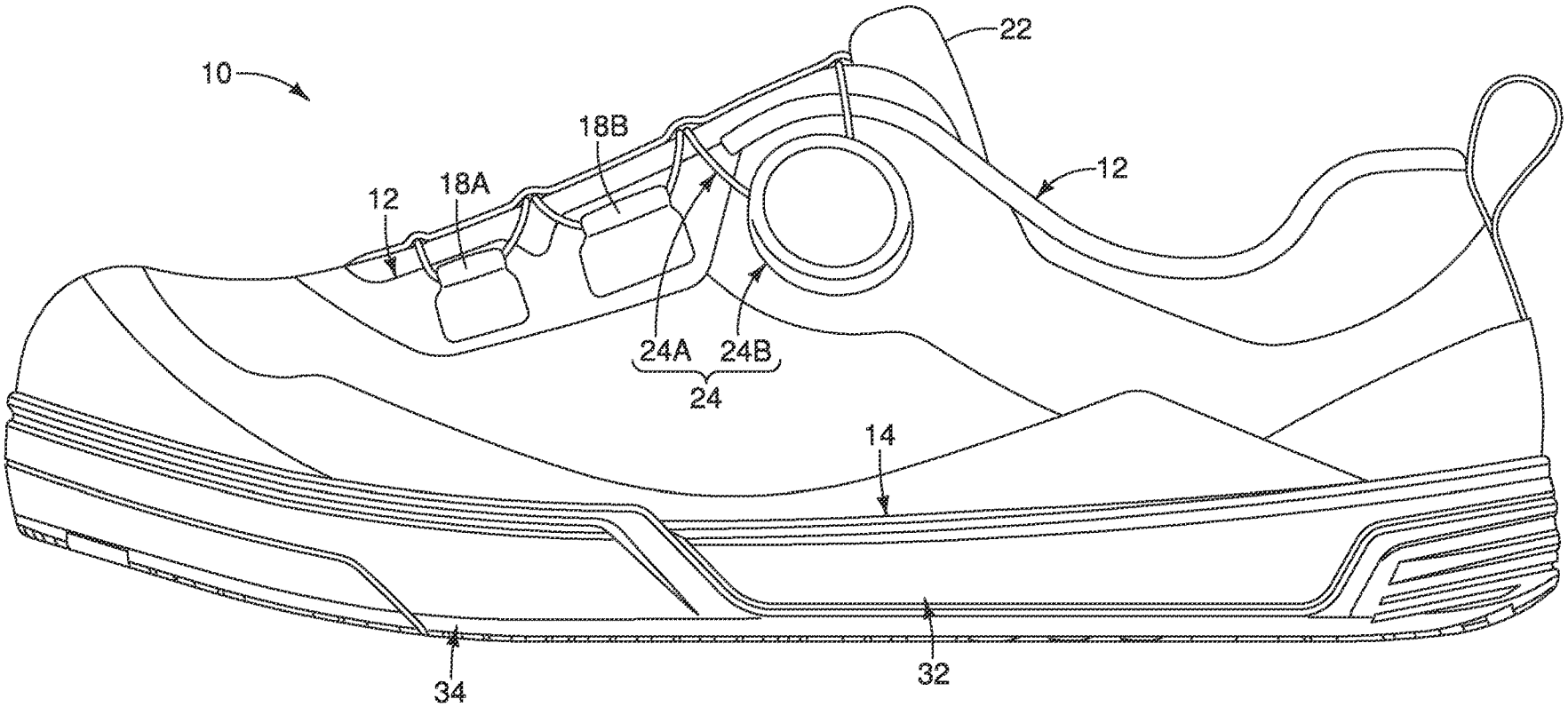
FIG. 1 is an outer side elevational view of a shoe having a shoe sole in accordance with a first embodiment.
Figure 2:
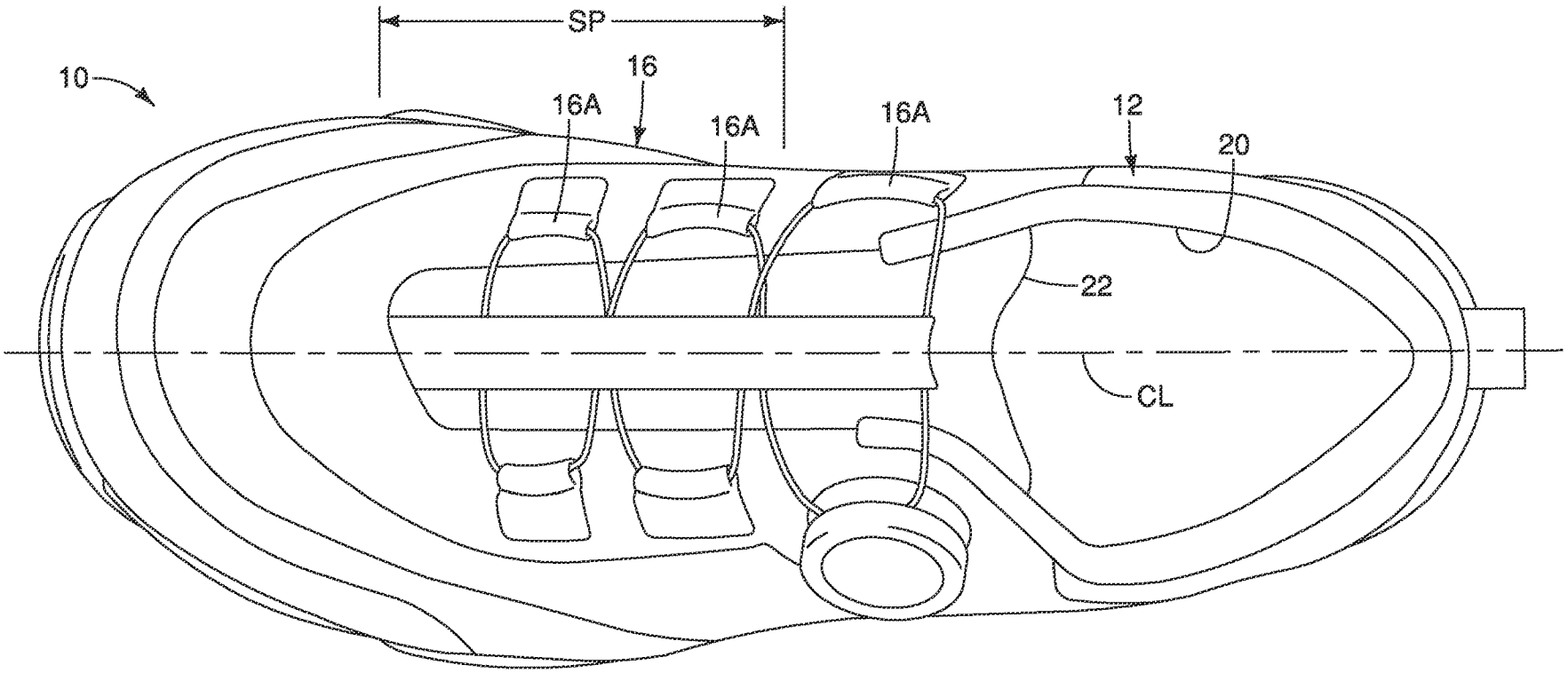
FIG. 2 is a top plan view of the shoe illustrated in FIG. 1.
Figure 3:
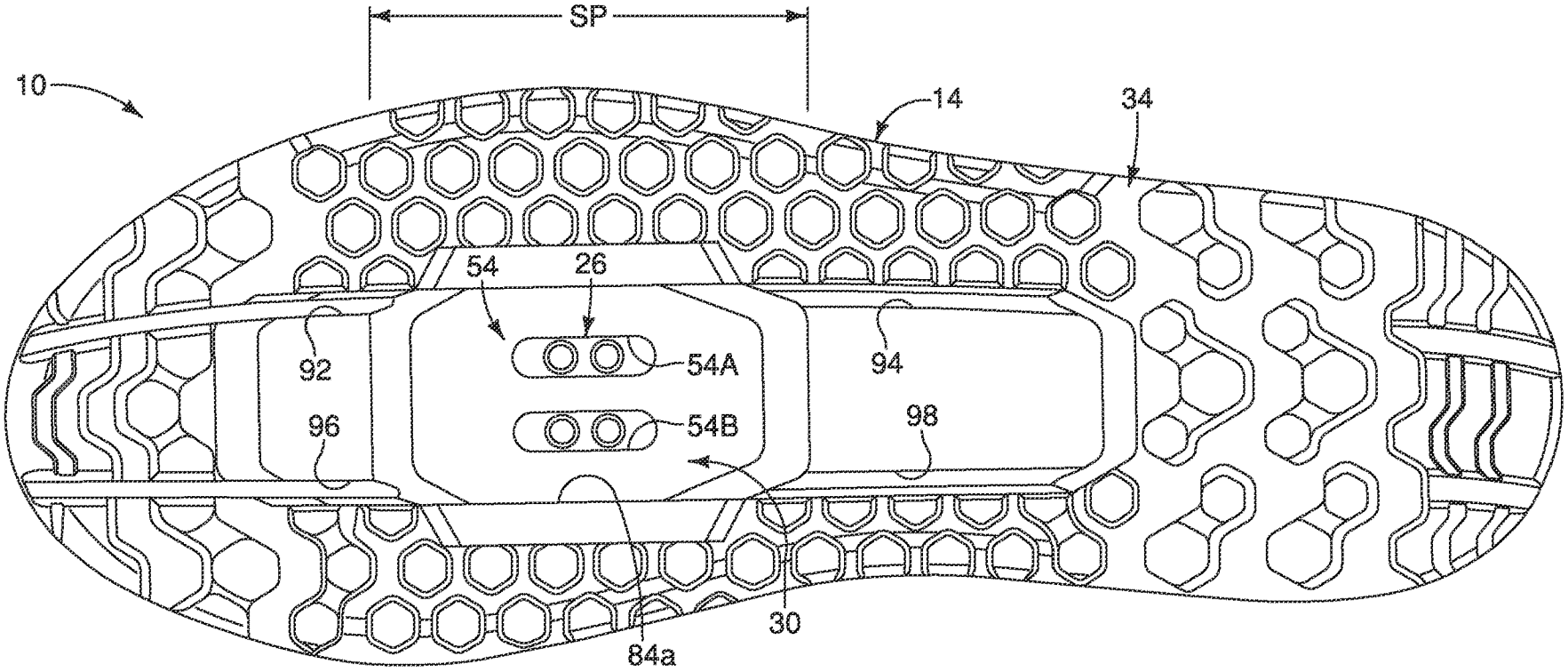
FIG. 3 is a bottom plan view of the shoe illustrated in FIG. 1.

Referring initially to FIGS. 1 to 3, a shoe 10 is illustrated in accordance with a first embodiment of the present disclosure. The shoe 10 is a left shoe of a pair of left-right symmetric ones, in which the right shoe is omitted. The right shoe is identical to the shoe 10 (the left shoe), except that the right shoe is a mirror image of the shoe 10 (the left shoe). Accordingly, description of the shoe 10 applies equally to the right shoe. Therefore, a description will be provided for only one of the shoes (the left shoe 10). The shoe 10 is especially suitable for cycling. However, the shoe 10 can be used for other actives other than cycling.

It should be understood from the drawings and the description herein that the terms "inner side" and "inboard side" refer to the right side of a shoe for the left foot, and the left side of a shoe for the right foot. In other words, the inner side or the inboard side is the side of the shoe facing the shoe on the other foot of the wearer. Similarly, the terms "outer side" and "outboard side" refer to the left side of the shoe for the left foot and the right side of the shoe for the right foot. The outer side or the outboard side is the side of the shoe facing away from the shoe on the other foot. As well, the terms "inner side" and "inboard side" are used interchangeably with respect to the present disclosure. Similarly, the terms "outer side" and "outboard side" are also used interchangeably with respect to the description of the present disclosure. Also, the term "outer instep side" refer to the left side of the shoe in the instep area for the left foot and the right side of the shoe in the instep area for the right foot. Similarly, the term "inner instep side" refer to the right side of the shoe in the instep area for the left foot and the left side of the shoe in the instep area for the right foot.

Figure 5:
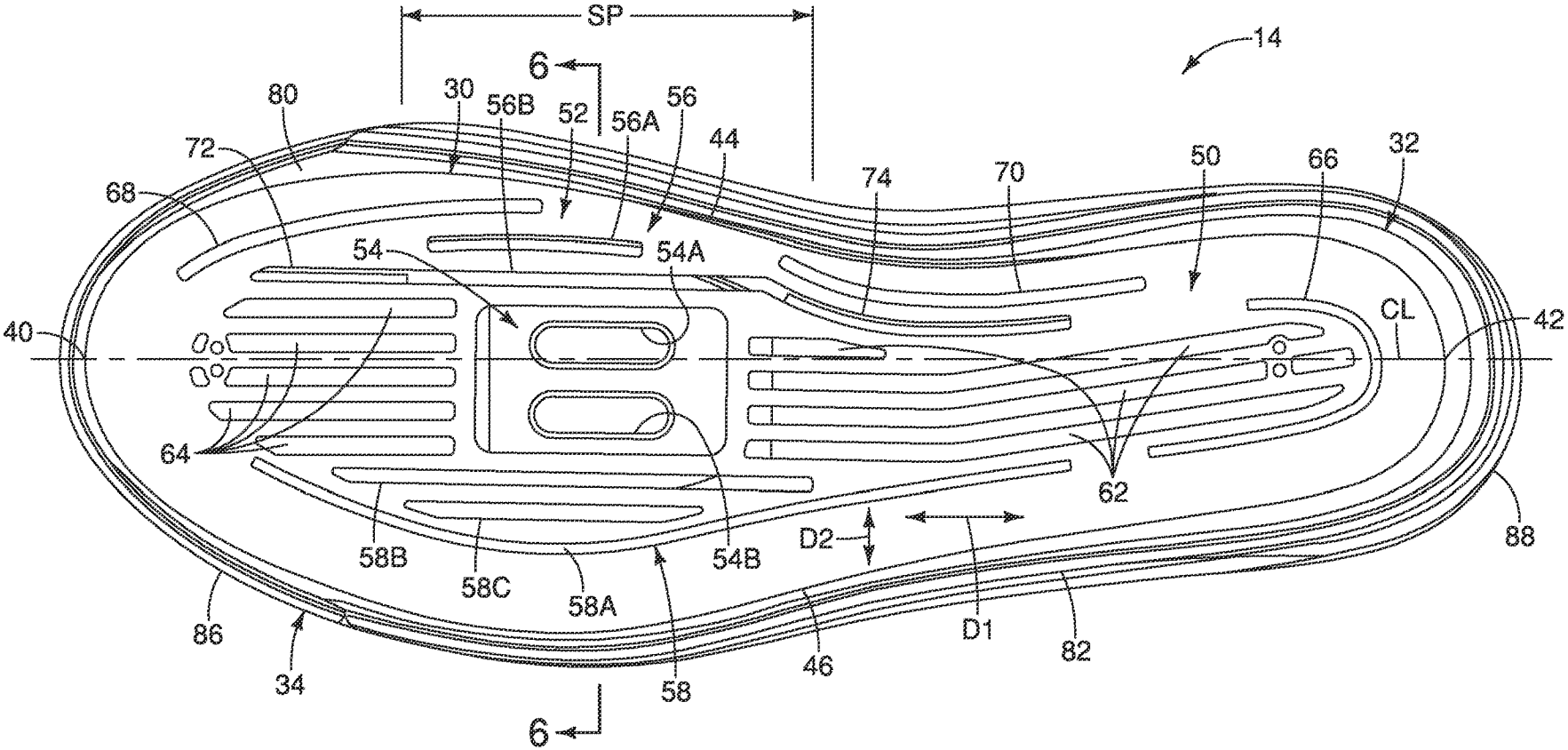
FIG. 5 is a top plan view of the shoe sole illustrated in FIG. 4.

Basically, the shoe 10 comprises an upper 12 and a shoe sole 14. In other words, the shoe 10 comprises the shoe sole 14 and further comprises the upper 12 which is attached to the shoe sole 14. As shown in FIGS. 2, 3 and 5, the shoe sole 14 includes a stepping part SP. The stepping part SP corresponds to the portion of the shoe 10 where a ball of a wearer's foot contacts the shoe sole 14. The stepping part SP is rearward of where wearer's toes contact the shoe sole 14 and forward of the arch of the wearer's foot in the shoe 10. The shoe 10 has a longitudinal centerline CL that extends between a front end of the shoe 10 and a rear end of the shoe 10.

Here, the upper 12 is a low-cut style of upper. However, the upper 12 is not limited to the low-cut style, but may be of any style. The upper 12 is made of any suitable natural or polymetric materials. The upper 12 can be formed of an expandable material or a non-expandable material. For example, the upper 12 can be made of a leather material, a nylon mesh and/or any other material that is utilized for conventional uppers.

As seen in FIG. 2, the upper 12 includes a first lateral side 16, a second lateral side 18 and an opening 20 between the first lateral side 16 and the second lateral side 18. The upper 12 further includes a tongue 22 between the first lateral side 16 and the second lateral side 18. The upper 12 further includes a closure 24 as a fastening structure for securing the shoe 10 to wearer's foot. The closure 24 includes at least one strap tightener 24A and at least one shoe strap 24B extending between the first lateral side 16 and the second lateral side 18. Here, the shoe strap 24B is a lace that is looped in eyelets 16A of the first lateral side 16 and that is looped in eyelets 18A of the second lateral side 18.

Alternatively, the upper 12 can include one or more fixing straps having a hook and loop fastener attachment with fabric hook and loop fastening materials. These fastening structures for securing shoes to wearer's feet are conventionally well-known structures. Thus, detail description of the fastening structures are omitted for the sake of brevity. The various portions of the upper 12 are stitched or otherwise fixed to one another. Since the present disclosure is applicable to a variety of differing shoe styles, designs and configuration, the depicted embodiment shows a basic shoe design that is made of several textile based materials that are sewn or stitched together to form the depicted shape. However, the present disclosure is not limited to the depicted shape, as will be understood from the description of the present disclosure below.

The shoe sole 14 supports the upper 12. Specifically, the shoe sole 14 is attached to the upper 12. The shoe sole 14 can be fixedly attached to the upper 12 in a conventional manner, such as with stitching, adhesives, and/or embedding portions of the upper 12 within the shoe sole 14. Thus, the upper 12 and the shoe sole 14 are integrated together. In the illustrated embodiment, the sole 14 is especially useful for cycling. Here, as seen in FIG. 3, the shoe 10 further includes a cleat attachment 26 that is provided to the shoe sole 14 for attaching a cleat.

Figure 4:
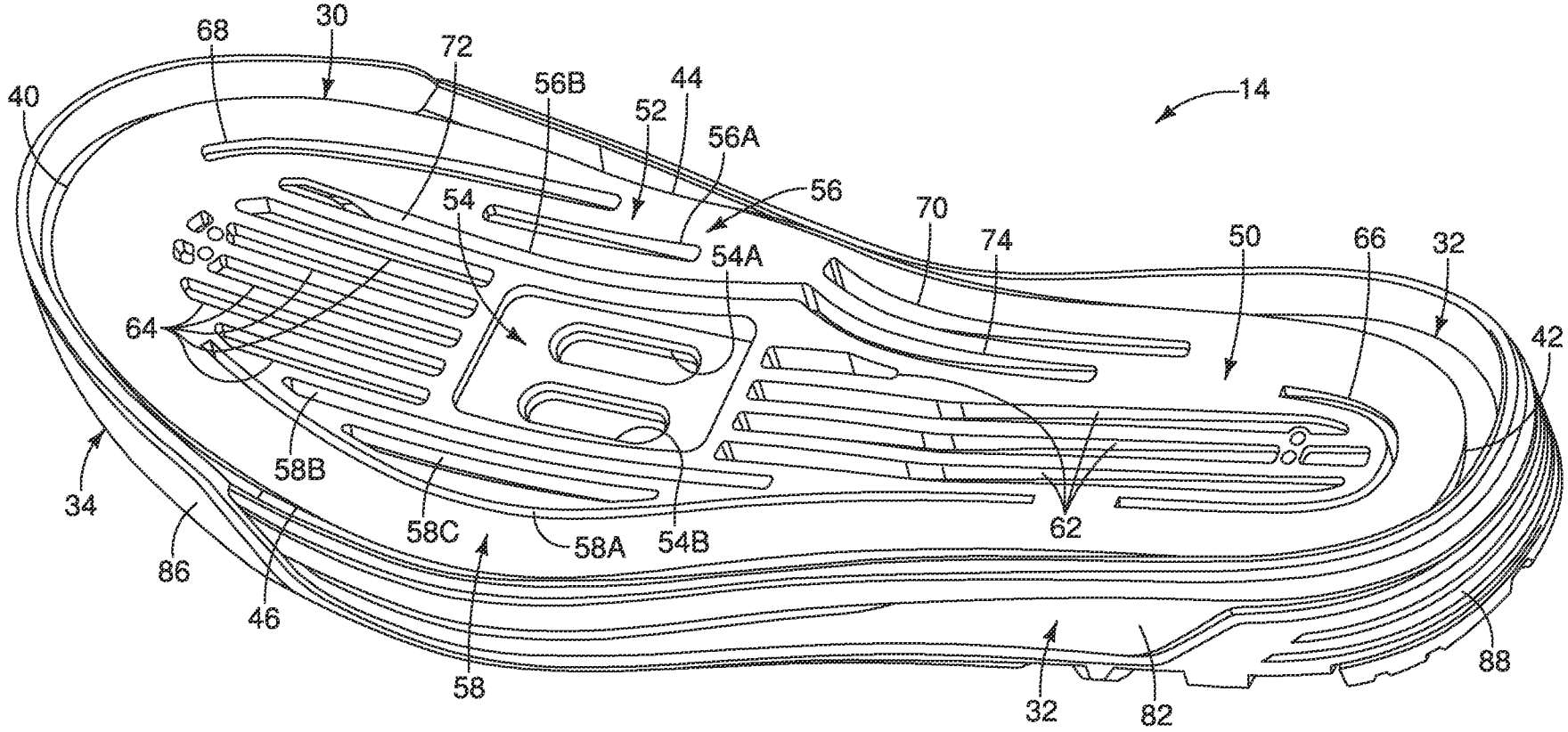
FIG. 4 is a top perspective view of the shoe sole of the shoe illustrated in FIGS. 1 to 3 as viewed from an outer side of the shoe sole.
Figure 6:
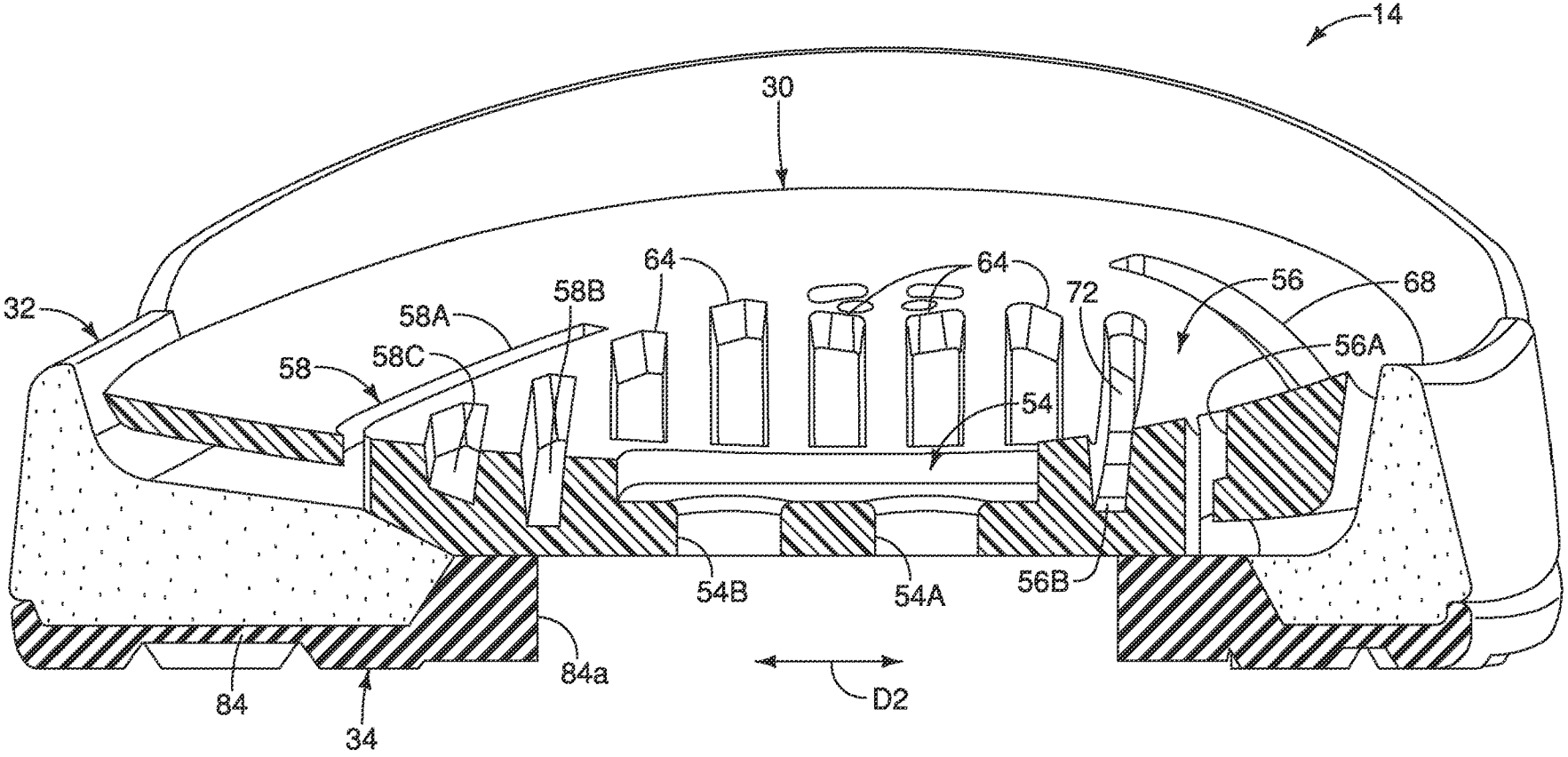
FIG. 6 is a cross sectional view of the shoe sole illustrated in FIGS. 4 and 5 taken along section line 6-6 of FIG. 5.
Figure 7:
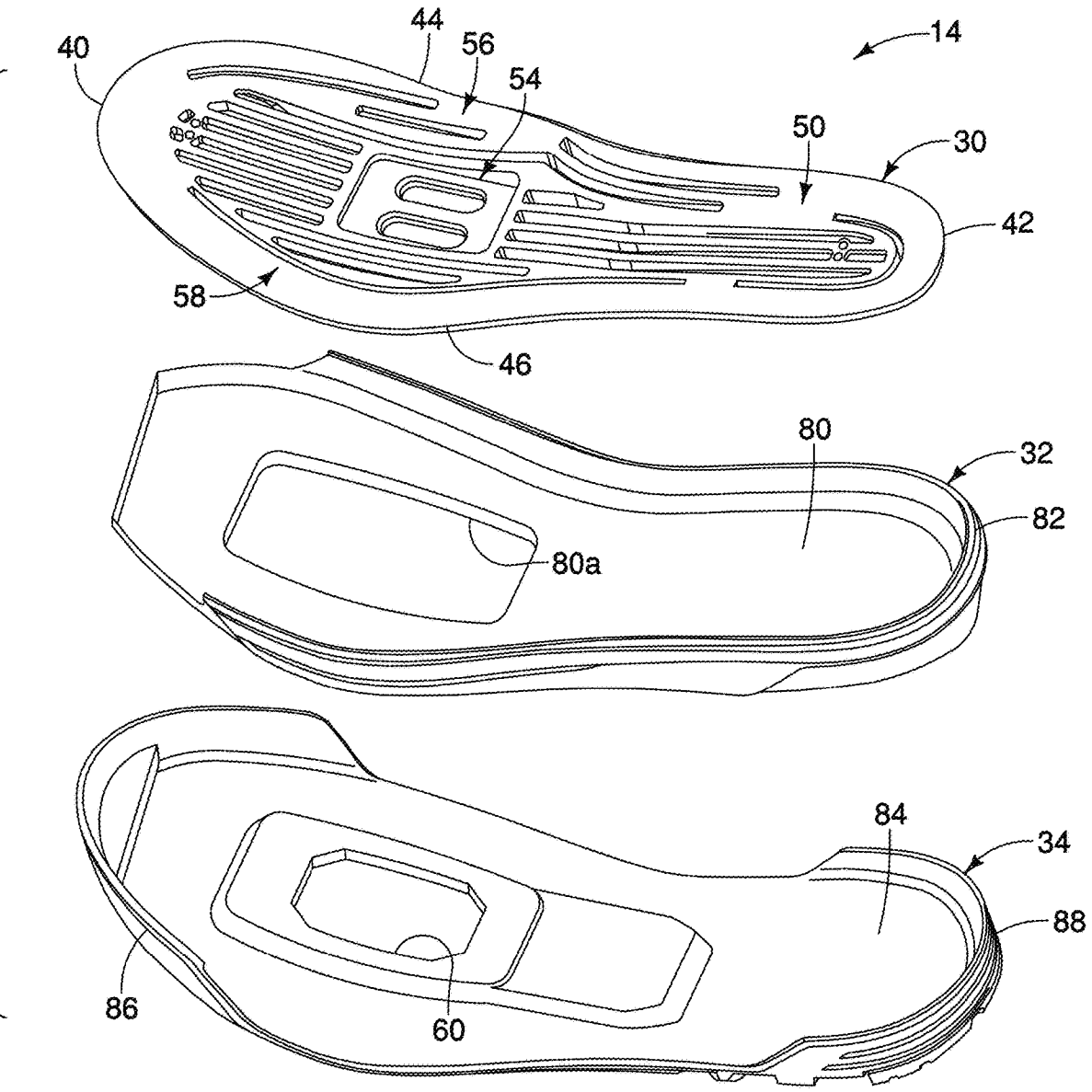
FIG. 7 is an exploded top perspective view of the shoe sole illustrated in FIGS. 4 to 6 as viewed from an outer side of the shoe sole.
Figure 8:
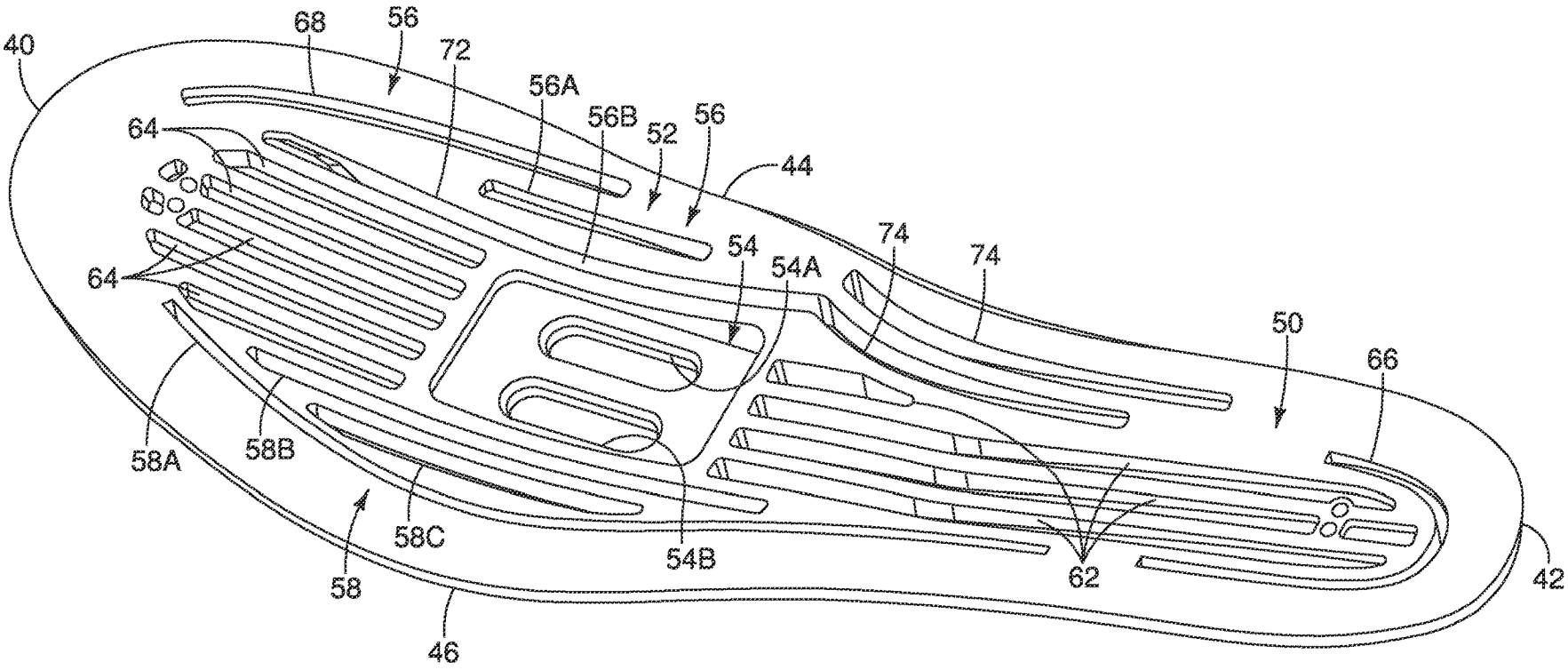
FIG. 8 is a top perspective view of a first layer of the shoe sole illustrated in FIGS. 4 to 7.
Figure 9:
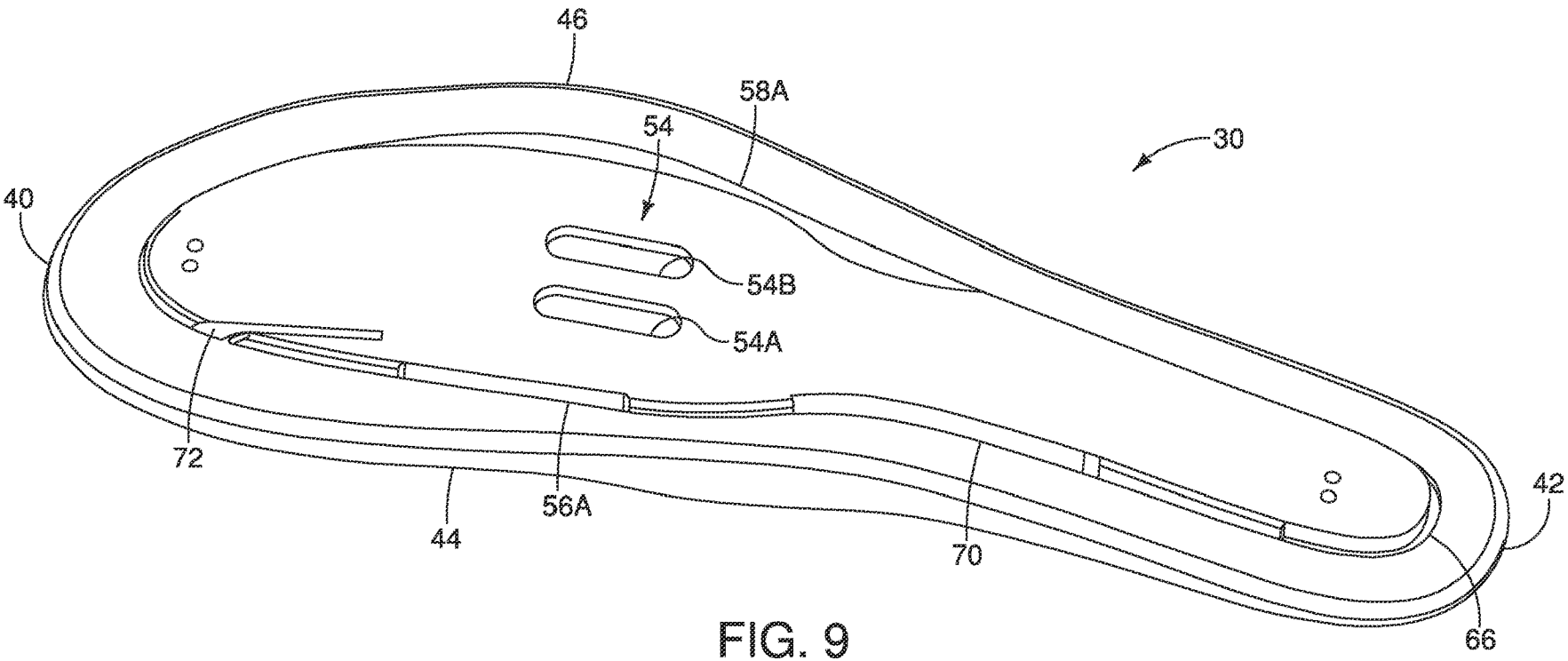
FIG. 9 is a bottom perspective view of the first layer illustrated in FIG. 8.
Figure 10:
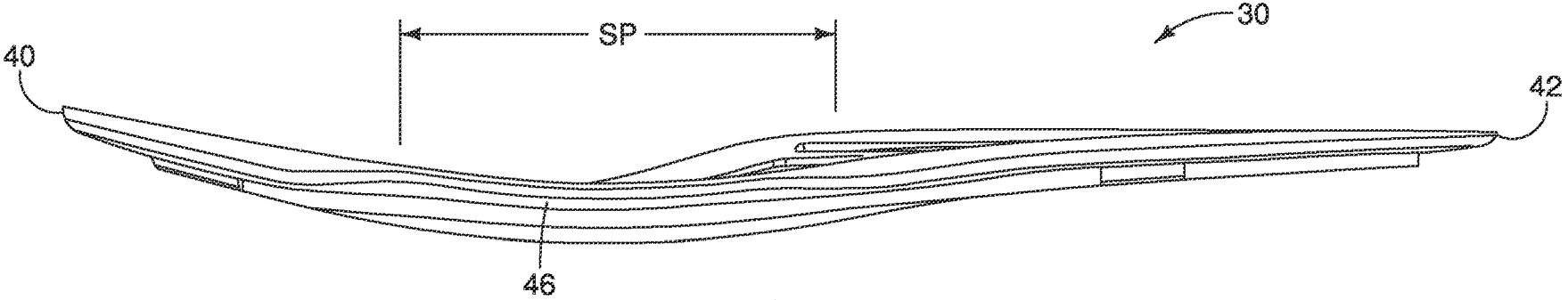
FIG. 10 is an outer side elevational view of the first layer illustrated in FIGS. 8 and 9.
Figure 11:
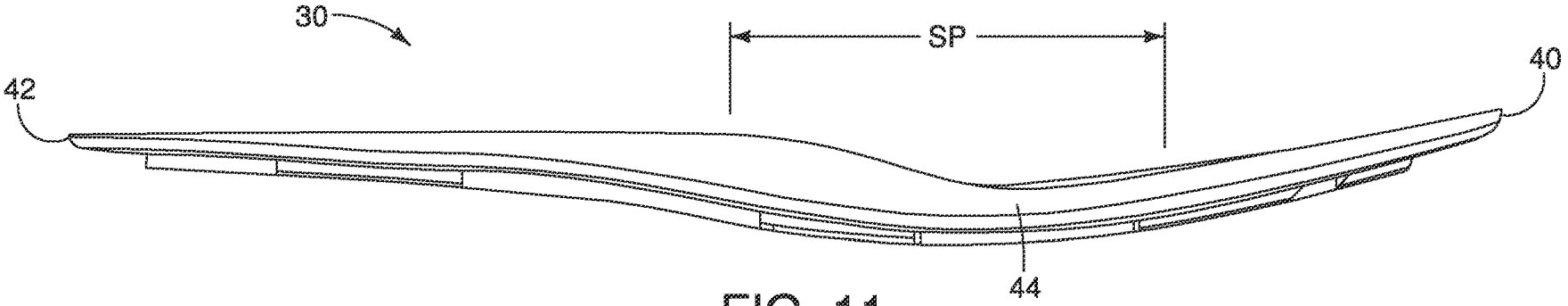
FIG. 11 is an inner side elevational view of the first layer illustrated in FIGS. 8 to 10.

As seen in FIGS. 4 to 6, the shoe sole 14 comprises a first sole layer 30. The first sole layer 30 constitutes a first midsole layer. An insole can be inserted into the shoe to for overlying an upper surface of the first sole layer 30. Preferably, the shoe sole 14 further comprises a second sole layer 32 at least partly overlapping the first sole layer 30. The second sole layer 32 constitutes a second midsole layer. Thus, the first sole layer 30 and the second sole layer 32 constitute a midsole of the shoe 10. In the first embodiment, the first sole layer 30 is disposed adjacent to an upper 12 of the shoe 10 in a state where the shoe sole 14 is coupled to the upper 12. Also, preferably, in the first embodiment, the shoe sole 14 further comprises a third sole layer 34. The third sole layer 34 is disposed on an opposite side of the second sole layer 32 with respect to the first sole layer 30. In other words, the second sole layer 32 is disposed between the first sole layer 30 and the third sole layer 34. In particular, the second sole layer 32 overlies the third sole layer 34, and the first sole layer 30 overlies the second sole layer 32. Thus, the first sole layer 30 is disposed closer to a top of the shoe sole 14 than the second sole layer 32 in a state where the shoe sole 14 is assembled. While the shoe sole 14 of the first embodiment has three layers, it will be apparent from this disclosure that the shoe sole 14 can have fewer than three layers or more than three layers. For example, the shoe sole 14 can have only the first sole layer 30 if needed and/or desired.

The first sole layer 30 includes a first material. The second sole layer 32 includes a second material. The second material is different from the first material. In the first embodiment, the first material includes a plastic material. For example, the first material of the first sole layer 30 includes a fiber (e.g., carbon fibers, glass fibers, etc.) reinforced plastic (FRP). The first sole layer 30 has a first flexibility. In the first embodiment, the second material includes an elastic material. For example, the second material of the second sole layer 32 includes an ethylene-vinyl acetate (EVA) copolymer, or a urethane. The second sole layer 32 can be formed by molding. The second sole layer 32 has a second flexibility that is more flexible than the first flexibility. The third sole layer 34 includes an elastic polymer material such as synthetic rubber or polyurethane (e.g., a thermoplastic polyurethane). The third sole layer 34 can be formed by injection molding.

Here, each of the first sole layer 30, the second sole layer 32, and the third sole layer 34 is a one-piece member is a one-piece member. The first sole layer 30, the second sole layer 32 and the third sole layer 34 are integrated together as a unit. The first sole layer 30 can be partly or fully embedded in the second sole layer 32, or can be adhesively attached to the second sole layer 32. The third sole layer 34 can molded to the second sole layer 32, or can be adhesively attached to the second sole layer 32. Alternatively, second sole layer 32 can molded to the third sole layer 34. The third sole layer 34 has an outer foot shape. Here, the third sole layer 34 is an outsole that is configured to contact the ground when walking, or a pedal when riding a bicycle.

As seen in FIG. 5, the first sole layer 30 has an outer shape formed in a foot shape. The outer shape of the first sole layer 30 is slightly smaller than the outer shapes of the second sole layer 32 and the third sole layer 34. However, the first sole layer 30 does not need to be foot shaped and/or cover most of the second sole layer 32. The first sole layer 30 has a toe edge 40 and a heel edge 42. The longitudinal centerline CL extends between the toe edge 40 and the heel edge 42. The first sole layer 30 has an inner side edge 44 and an outer side edge 46. The inner side edge 44 and the outer side edge 46 extend between the toe edge 40 and the heel edge 42 to define a periphery of the first sole layer 30.

The first sole layer 30 includes a first region 50 having a first rigidity, and a second region 52 having a second rigidity that is more flexible than the first rigidity. The second sole layer 32 having a third rigidity that is more flexible than the first rigidity. The third sole layer 34 has a fourth rigidity that is less rigid than the first rigidity.

The first region 50 corresponds to those portions of the first sole layer 30 that is free of a through opening, a groove, or a reduced thickness. The second regions 52 correspond to those portions of the first sole layer 30 that include at least one of a through opening, a groove, a reduced thickness, or a material of reduced rigidity as compared to the rigidity of the material of the first region 50. The second region 52 extends in a longitudinal direction D1 of the shoe sole 14. The second region 52 is spaced from the toe edge 40 of the first sole layer 30, and is spaced from the heel edge 42 of the first sole layer 30. In other words, a portion of the first region 50 having the first rigidity is disposed between the toe edge 40 and the second region 52. Also, a portion of the first region 50 having the first rigidity is disposed between the heel edge 42 and the second region 52. The first sole layer 30 has a cleat engagement part 54. The cleat engagement part 54 is configured to receive the cleat attachment 26 (see FIG. 3) for attaching a cleat to the first sole layer 30. Here, the cleat engagement part 54 includes at least two attachment openings 54A and 54B. The second region 52 extends to a stepping part SP of the shoe sole 14 in the longitudinal direction D1 of the shoe sole 14. The first region 50 also extends in the longitudinal direction D1 of the shoe sole 14 to maintain longitudinal rigidity. The second region 52 is located between the cleat engagement part 54 and the side edge 44 of the first sole layer 30. In this way, the rigidity of the first sole layer 30 is reduced in the area between the cleat engagement part 54 and the side edge 44 of the first sole layer 30.

The second region 52 includes a first part 56 and a second part 58. The first part 56 is located on an inner instep side of the cleat engagement part 54. In other words, the first part 56 is located between the inner side edge 44 and the cleat engagement part 54. The second part 58 is located on an outer instep side of the cleat engagement part 54. In other words, the second part 58 is located between the outer side edge 46 and the cleat engagement part 54. The second part 58 is longer than the first part 56.

Preferably, as in the first embodiment, the second region 52 includes at least one elongated through opening. More preferably, as in the first embodiment, the second region 52 includes a plurality of elongated through openings. Alternatively, one or more of the elongated through openings can be an elongated area of reduced rigidity such as a groove or a material of reduced rigidity as compared to the first region 50. Here, the first part 56 includes a first elongated through opening 56A and the second part 58 includes a second elongated through opening 58A. The second elongated through opening 58A is longer than the first elongated through opening 56A.

In the first embodiment, the first part 56 further includes a first elongated groove 56B, and the second part 58 includes a second elongated groove 58B and a third elongated groove 58C. The first elongated groove 56B, the second elongated groove 58B and the third elongated groove 58C are disposed in the upper surface of the first sole layer 30. The first elongated groove 56B is longer than the first elongated through opening 56A. The first elongated groove 56B is located between the cleat engagement part 54 and the first elongated through opening 56A with respect to the lateral direction D2 of the shoe sole 14. The second elongated groove 58B is shorter than the second elongated through opening 58A and longer than the third elongated groove 58C. The second elongated groove 58B and a third elongated groove 58C are located between the cleat engagement part 54 and the second elongated through opening 58A with respect to the lateral direction D2 of the shoe sole 14.

Figure 12:
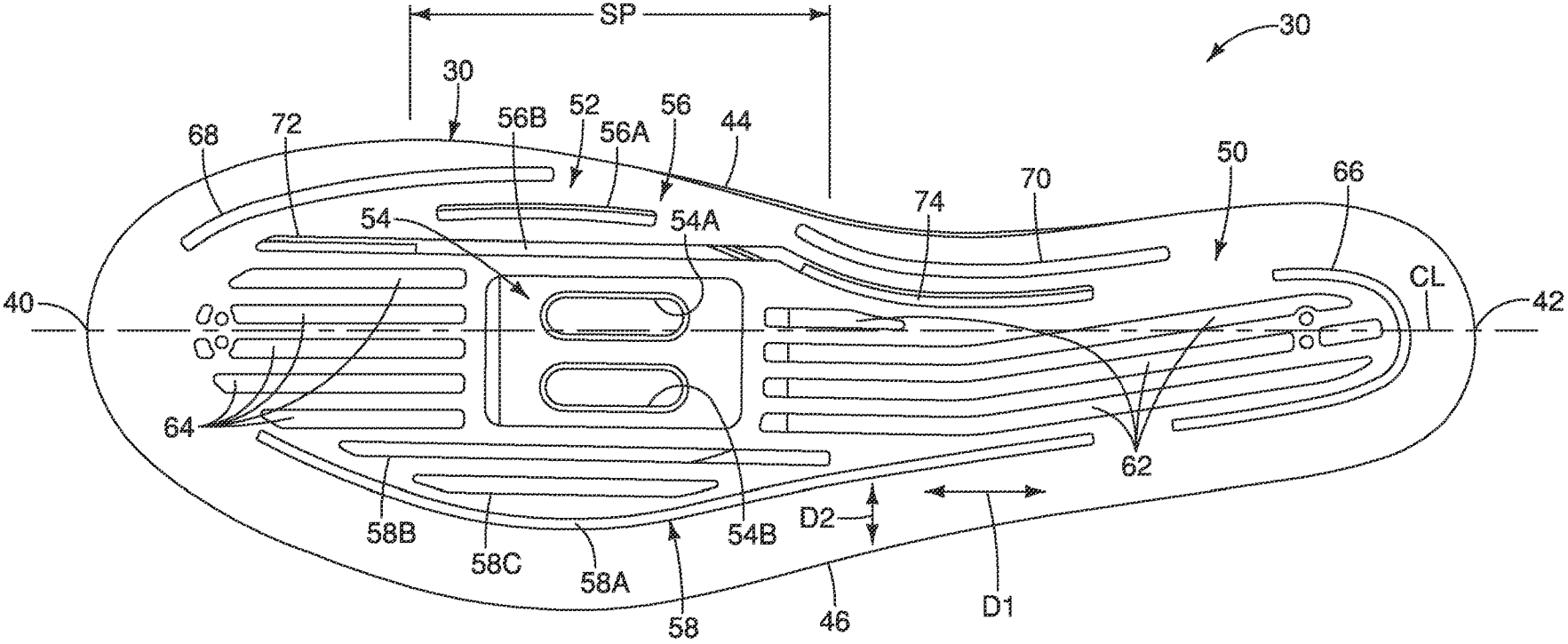
FIG. 12 is a top plan view of the first layer illustrated in FIGS. 8 to 11.
Figure 13:
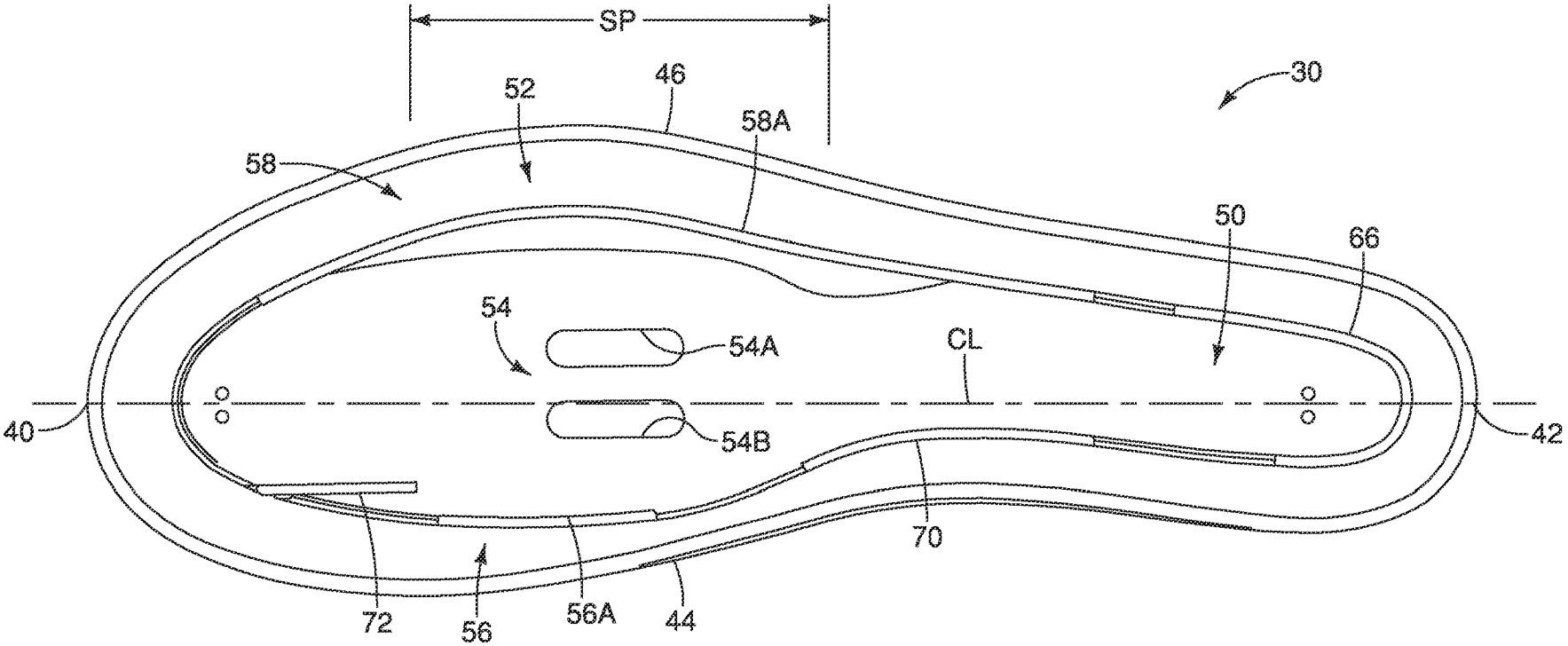
FIG. 13 is a bottom plan view of the first layer illustrated in FIGS. 7 to 12.

Preferably, as seen in FIG. 12, optionally, the first sole layer 30 has a plurality of elongated grooves 62 located rearward of the cleat engagement part 54, and a plurality of elongated grooves 64 located in front of the cleat engagement part 54. The elongated grooves 62 and 64 are disposed in the upper surface of the first sole layer 30. The elongated grooves 62 and 64 extend in the longitudinal direction D1 of the shoe sole 14. The elongated grooves 64 are parallel to the longitudinal centerline CL. Also, optionally, the first sole layer 30 has an elongated through openings 66 located in a heel part of the first sole layer 30. Also, optionally, the first sole layer 30 has an elongated groove 68 located in the toe area of the first sole layer 30 on the inner instep side, and an elongated groove 70 located in the heel area of the first sole layer 30. The elongated grooves 68 and 70 are disposed in the upper surface of the first sole layer 30. The elongated grooves 68 and 70 are curved and are substantially parallel to the inner side edge 44. Also, optionally, the first sole layer 30 has a first additional elongated through opening 72 and a second additional elongated through 74. The first additional elongated through opening 72 is located in front of the cleat engagement part 54. The second additional elongated through 74 is located rearward of the cleat engagement part 54. The first elongated groove 56B is contiguous with the first additional elongated through opening 72 and the second additional elongated through 74.

Referring to FIG. 6, the second sole layer 32 includes a base portion 80 that is foot-shaped. The base portion 80 is larger than the first sole layer 30. Thus, the base portion 80 supports the first sole layer 30. The base portion 80 includes an opening 80*a* so that the cleat engagement part 54 of the first sole layer 30 is accessible through the opening 80*a*. The second sole layer 32 further includes a side portion 82 that partially overlies the upper 12 (see FIG. 1). Preferably, the upper 12 is attached to the side portion 82 by stitching, adhesives, and/or embedding portions of the upper 12 within the side portion 82.

Still referring to FIG. 6, the third sole layer 34 includes a base portion 84 that is foot-shaped. The base portion 84 is larger than the base portion 80 of the second sole layer 32. Thus, the base portion 84 of the third sole layer 34 supports the base portion 80 of the second sole layer 32. The base portion 84 includes an opening 84*a* so that the cleat engagement part 54 of the first sole layer 30 is accessible through the opening 84*a*. The opening 84*a* defines a recess that is sized to receive a cleat that is configured to engage a clipless pedal (i.e., a step-in type pedal). In this way, the cleat does not contact the ground while walking. The third sole layer 34 further includes a first side portion 86 and a second side portion 88. The first side portion 86 and the second side portion 88 partially overlie the upper 12 (see FIG. 1). Preferably, the upper 12 is attached to the first side portion 86 and the second side portion 88 by stitching, adhesives, and/or embedding portions of the upper 12 within first side portion 86 and the second side portion 88.

Here, as seen in FIG. 3, in the first embodiment, the third sole layer 34 includes reduced thickness areas 92, 94, 96 and 98. Preferably, the reduced thickness areas 92, 94, 96 and 98 grooves that at least partially cover the first part 56 and the second part 58. More specifically, the reduced thickness area 92 partially overlaps the first elongated groove 56B and the first additional elongated through opening 72. The reduced thickness area 94 partially overlaps the first elongated groove 56B and the second additional elongated through opening 72. The reduced thickness areas 96 and 98 partially overlap the second elongated groove 58B.

Figure 14:
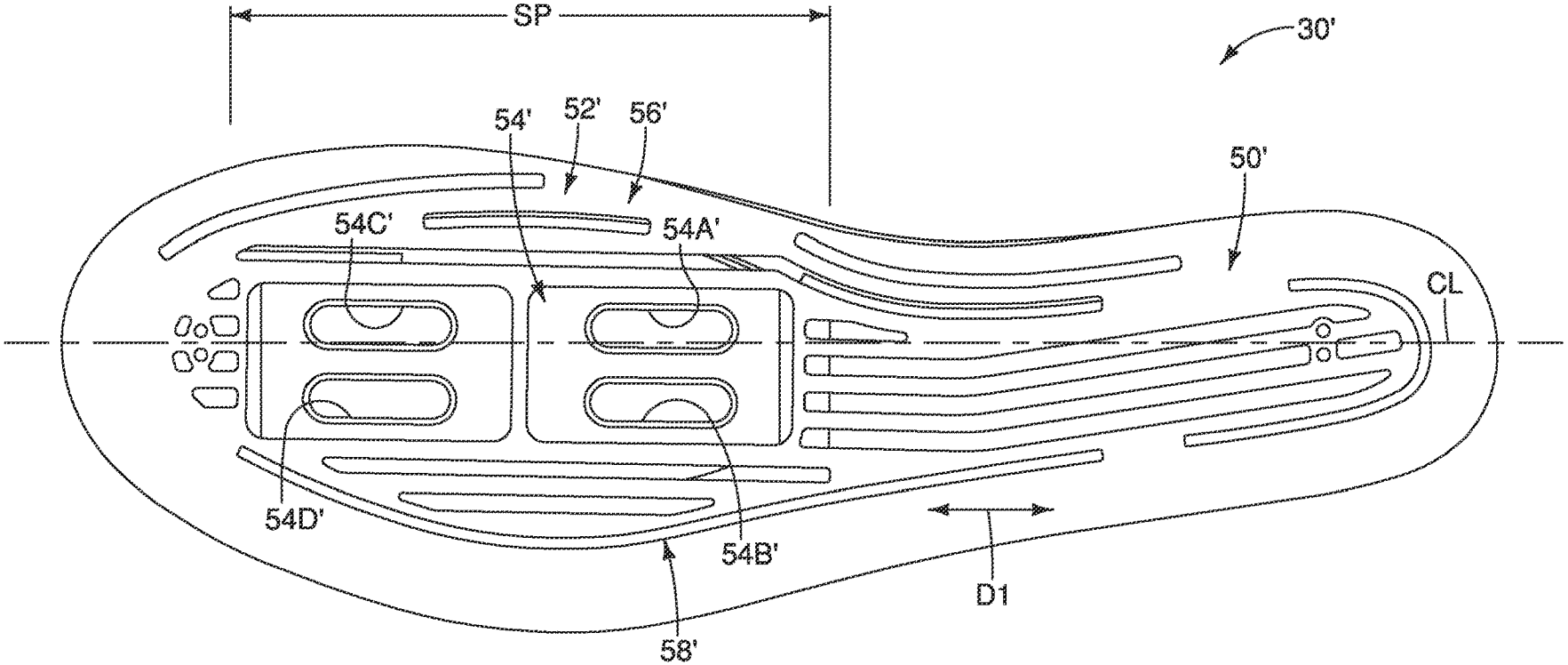
FIG. 14 is a bottom plan view of a modified first layer for use in the shoe illustrated in FIGS. 1 to 3.

Referring now to FIG. 14, a first sole layer 30' is illustrated in accordance with a first modification. The first sole layer 30' includes a first region 50', a second region 52' and a cleat engagement part 54'. The first region 50' of the first sole layer 30' is identical to the first region 50 of the first sole layer 30, and the second region 52' of the first sole layer 30' is identical to the second region 52 of the first sole layer 30. Thus, the second region 52' includes a first part 56', which is identical to the first part 56 discussed above, and a second part 58', which is identical to the second part 58 discussed above. However, the cleat engagement part 54' has been modified to have four slots 54A', 54B', 54C' and 54D'.

Figure 15:
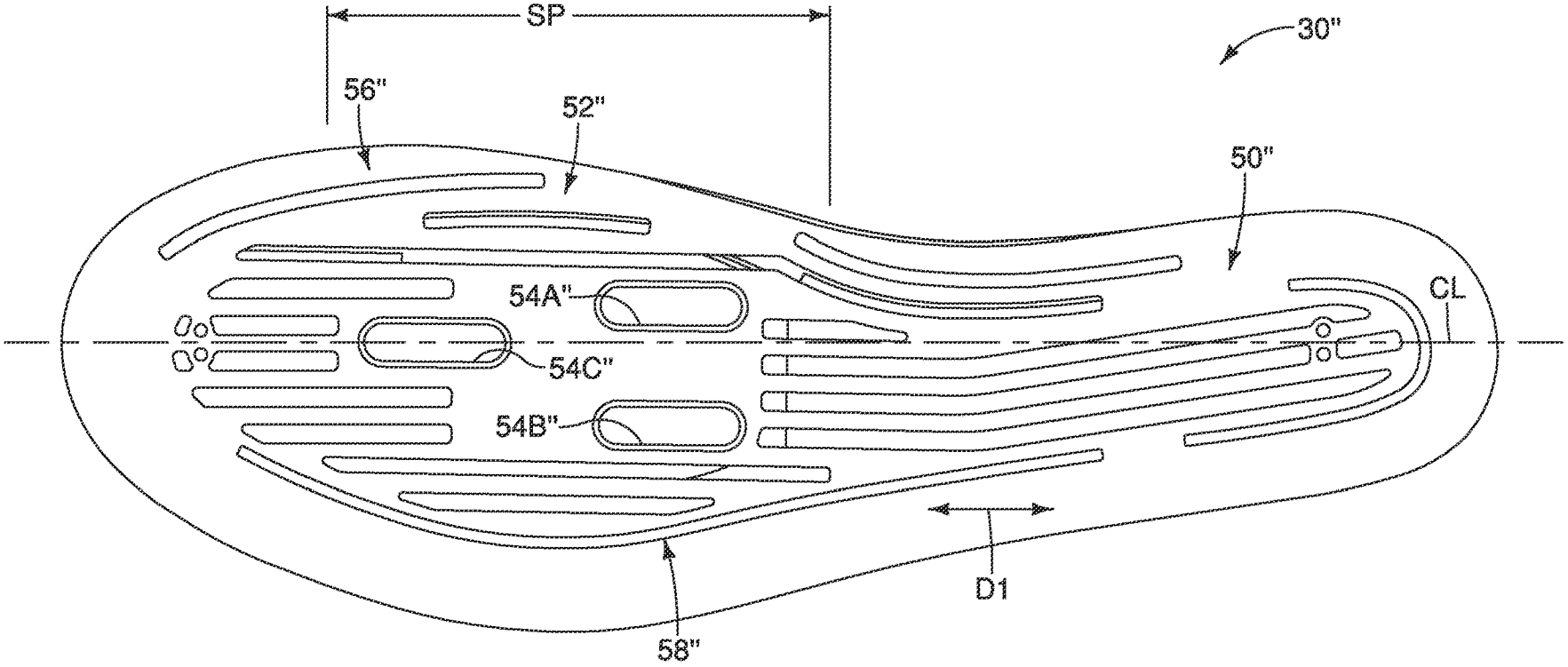
FIG. 15 is a bottom plan view of another modified first layer for use in the shoe illustrated in FIGS. 1 to 3.

Referring now to FIG. 15, a first sole layer 30" is illustrated in accordance with a first modification. The first sole layer 30" includes a first region 50", a second region 52" and a cleat engagement part 54". The first region 50" of the first sole layer 30" is identical to the first region 50 of the first sole layer 30, and the second region 52" of the first sole layer 30" is identical to the second region 52 of the first sole layer 30. Thus, the second region 52" includes a first part 56", which is identical to the first part 56 discussed above, and a second part 58", which is identical to the second part 58 discussed above. However, the cleat engagement part 54" has been modified to have four slots 54A", 54B", 54C" and 54D".

Figure 16:
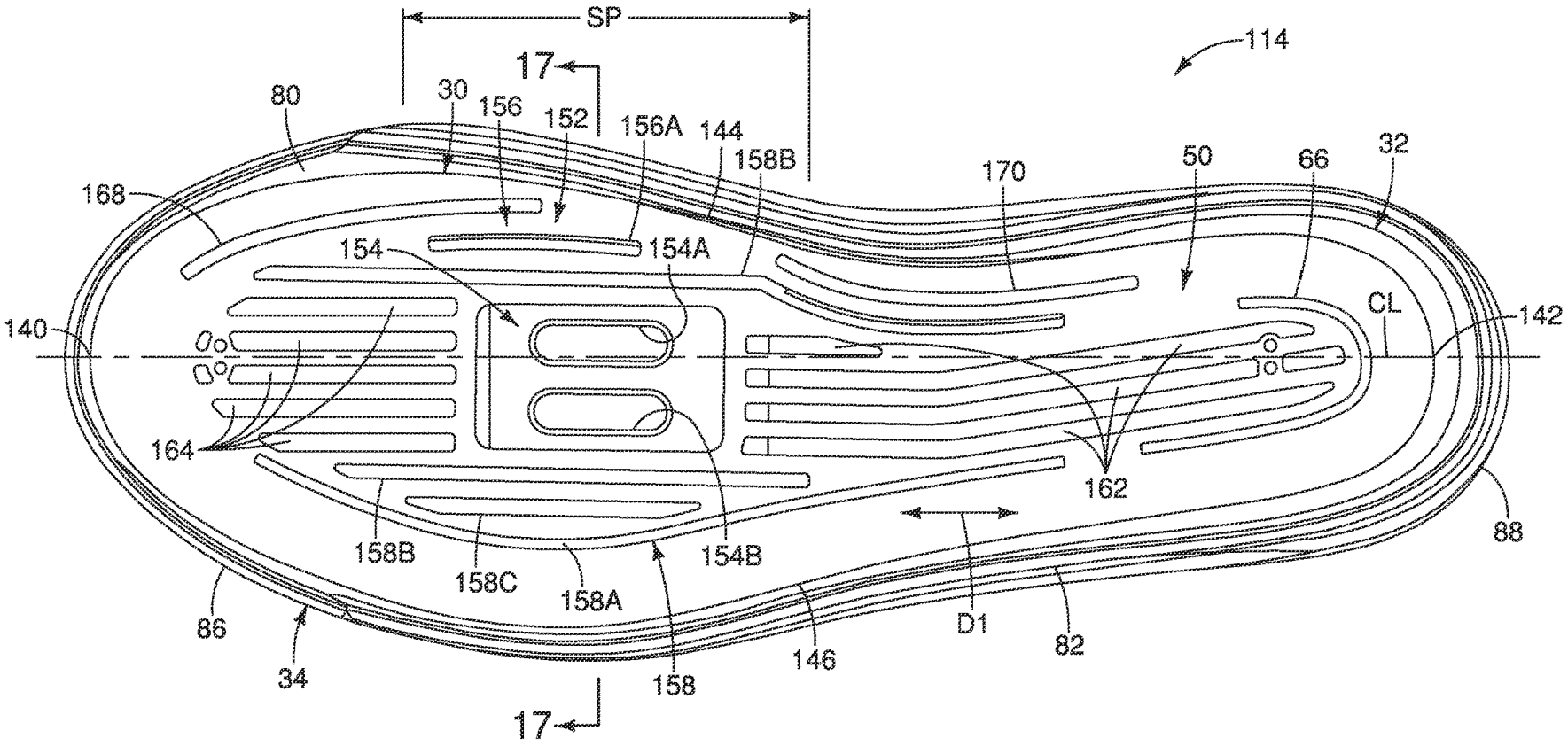
FIG. 16 is top plan view of a modified shoe sole in accordance with a second embodiment for use in the shoe illustrated in FIGS. 1 to 3.
Figure 17:
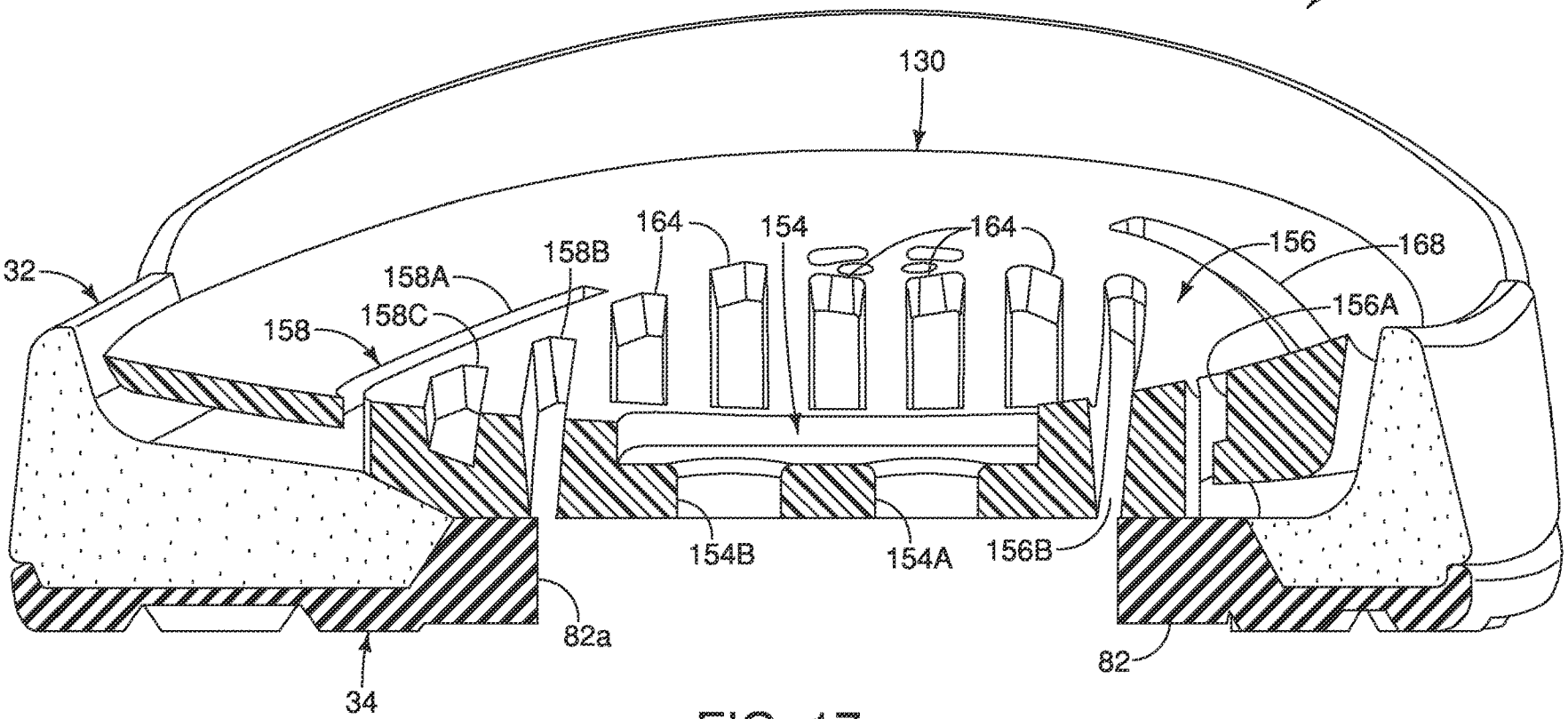
FIG. 17 is a cross sectional view of the shoe sole illustrated in FIG. 16 taken along section line 17-17 of FIG. 5.

Referring now to FIGS. 16 and 17, a shoe sole 114 is illustrated in accordance with a second embodiment. The shoe sole 114 can be used with the upper 12 to form a shoe similar to the first embodiment. Here, the shoe sole 114 comprises a first sole layer 130 and further comprises the second sole layer 32 and the third sole layer 34 of the first embodiment. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity. Thus, the following description will focus on the first sole layer 130.

Here, the first sole layer 130 overlies the second sole layer 32, which overlies the third sole layer 34 in the same manner as the first embodiment. Preferably, the first sole layer 130 is made of a plastic material having a first flexibility. Thus, the second flexibility of the second sole layer 32 is more flexible than the first flexibility of the first sole layer 130. Also, the third flexibility of the third sole layer 34 is more flexible than the first flexibility of the first sole layer 130.

As seen in FIG. 16, the first sole layer 130 has an outer shape formed in a foot shape. The outer shape of the first sole layer 130 is slightly smaller than the outer shapes of the second sole layer 32 and the third sole layer 34. The first sole layer 130 has an inner side edge 144 and an outer side edge 146. The inner side edge 144 and the outer side edge 146 extend between the toe edge 140 and the heel edge 142 to define a periphery of the first sole layer 130.

The first sole layer 130 includes a first region 150 having a first rigidity, and a second region 152 having a second rigidity that is more flexible than the first rigidity. The first region 150 corresponds to those portions of the first sole layer 130 that is free of a through opening, a groove, or a reduced thickness. The second regions 152 correspond to those portions of the first sole layer 130 that include at least one of a through opening, a groove, a reduced thickness, or a material of reduced rigidity as compared to the rigidity of the material of the first region 150. The second sole layer 132 has a third rigidity that is more flexible than the first rigidity. Preferably, the second region 152 extends in a longitudinal direction D1 of the shoe sole 114. The second region 152 is spaced from the toe edge 140 of the first sole layer 130. Also, the second region 152 is spaced from the heel edge 142 of the first sole layer 130. In other words, a portion of the first region 150 having the first rigidity is disposed between the toe edge 140 and the second region 152. Also, a portion of the first region 150 having the first rigidity is disposed between the heel edge 142 and the second region 152. The first sole layer 130 has a cleat engagement part 154. The cleat engagement part 154 is configured to receive the cleat attachment 26 (see FIG. 3) for attaching a cleat to the first sole layer 130.

The second region 152 extends to a stepping part SP of the shoe sole 114 in the longitudinal direction D1 of the shoe sole 114. The first region 150 also extends in the longitudinal direction D1 of the shoe sole 114 to maintain longitudinal rigidity. The second region 152 is located between the cleat engagement part 154 and the inner side edge 144 of the first sole layer 130. In this way, the rigidity of the first sole layer 130 is reduced in the area between the cleat engagement part 154 and the inner side edge 144 of the first sole layer 130.

The second region 152 includes a first part 156 and a second part 158. The first part 156 is located on an inner instep side of the cleat engagement part 154. In other words, the first part 156 is located between the inner side edge 144 and the cleat engagement part 154. The second part 158 is located on an outer instep side of the cleat engagement part 154. In other words, the second part 158 is located between the outer side edge 146 and the cleat engagement part 154. In the second embodiment, each of the first part 156 and the second part 158 includes at least one first elongated through opening, and the third sole layer 24 includes at least one opening aligned with the at least one elongated through opening of each of the first part 156 and the second part 158. More preferably, in the second embodiment, each of the first part 156 and the second part 158 includes a plurality of elongated through openings. Here, the first part 156 includes a first elongated through opening 156A. Thus, the first elongated through opening 156A is located on the inner instep side of the cleat engagement part 154. The second part 158 includes a second elongated through opening 158A. Thus, the second elongated through opening 158A is located on the inner instep side of the cleat engagement part 154. Preferably, the second elongated through opening 158A is longer than the first elongated through opening 156A. The first part 156 further includes a third elongated through opening 156B, and the second part 158 further includes a fourth elongated through opening 158B. The third elongated through opening 156B is located on the inner instep side of the cleat engagement part 154. The fourth elongated through opening 158B is located on the outer instep side of the cleat engagement part 154. Here, the third elongated through opening 156B and the fourth elongated through opening 158B are approximately the same size (i.e., ±10%). In the second embodiment, as seen in FIG. 17, the opening 84*a* is aligned with both the third elongated through opening 156B and the fourth elongated through opening 158B.

As mentioned above, as seen in FIG. 3, the third sole layer 34 includes the reduced thickness areas 92, 94, 96 and 98 at least partially covering the first part 156 and the second part 158. Here, the reduced thickness areas 92, 94, 96 and 98 grooves that at least partially cover the first part 156 and the second part 158. More specifically, the reduced thickness areas 92 and 94 partially overlap the third elongated through opening 156B. The reduced thickness areas 96 and 98 partially overlap fourth elongated through opening 158B.

As seen in FIG. 16, optionally, the first sole layer 130 has a plurality of elongated grooves 162 located rearward of the cleat engagement part 154, and a plurality of elongated grooves 164 located in front of the cleat engagement part 154. The elongated grooves 162 and 164 are disposed in the upper surface of the first sole layer 130. The elongated grooves 162 and 164 extend in the longitudinal direction D1 of the shoe sole 114. The elongated grooves 164 are parallel to the longitudinal centerline CL. Also, optionally, the first sole layer 130 has an elongated through openings 166 located in a heel part of the first sole layer 130. Also, optionally, the first sole layer 130 has an elongated groove 168 located in the toe area of the first sole layer 130 on the inner instep side, and an elongated groove 170 located in the heel area of the first sole layer 130. The elongated grooves 168 and 170 are disposed in the upper surface of the first sole layer 130. The elongated grooves 168 and 170 are curved and are substantially parallel to the inner side edge 144.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of".

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A shoe sole comprising:

a first sole layer including a first region having a first rigidity, and a second region having a second rigidity that is more flexible than the first rigidity and extending in a longitudinal direction of the shoe sole, the first sole layer having an inner side edge and an outer side edge; wherein the second region is spaced from a toe edge of the first sole layer and is spaced from a heel edge of the first sole layer, the inner and outer side edges extending between the toe edge and the heel edge to define a periphery of the first shoe layer, the first sole layer has a cleat engagement part, the cleat engagement part having at least two attachment openings, the at least two attachment openings including a toe end and a heel end, and the second region is located between the cleat engagement part and one of the inner and outer side edges of the first sole layer, the second region includes at least one through opening, the at least one through opening being disposed adjacent to the cleat engagement part and at least one of the inner and outer side edges, the at least one through opening having a toe opening end and a heel opening end, the toe end and the heel end of the at least two attachment openings overlapping the at least one through opening in a lateral direction of the shoe sole that is perpendicular to the longitudinal direction.

2. The shoe sole according to claim 1, wherein the at least one through opening of the second region includes at least one elongated through opening.

3. The shoe sole according to claim 1, wherein the second region extends to a stepping part of the shoe sole in the longitudinal direction of the shoe sole, the stepping part having a contact surface that contacts a ball of a wearer's foot when the shoe sole is being worn.

4. The shoe sole according to claim 1, wherein the first sole layer is disposed adjacent to an upper of a shoe in a state where the shoe sole is coupled to the upper.

5. The shoe sole according to claim 1, wherein the second region includes a first part and a second part, the first part is located on an inner instep side of the cleat engagement part, the second part is located on an outer instep side of the cleat engagement part.

6. The shoe sole according to claim 5, wherein the second part is longer than the first part.

7. The shoe sole according to claim 5, wherein the first part includes a first elongated through opening, and the second part includes a second elongated through opening that is longer than the first elongated through opening.

8. The shoe sole according to claim 5, further comprising a second sole layer at least partly overlapping the first sole layer, the second sole layer having a third rigidity that is more flexible than the first rigidity.

9. The shoe sole according to claim 8, wherein the first sole layer is disposed closer to a top of the shoe sole than the second sole layer in a state where shoe sole is assembled.

10. The shoe sole according to claim 8, further comprising a third sole layer having an outer foot shape, and having a fourth rigidity that is less rigid than the first rigidity.

11. The shoe sole according to claim 10, wherein the second sole layer is disposed between the first sole layer and the third sole layer.

12. The shoe sole according to claim 10, wherein the third sole layer includes reduced thickness areas at least partially covering the first part and the second part.

13. The shoe sole according to claim 11, wherein each of the first part and the second part includes at least one elongated through opening, and the third sole layer includes at least one opening aligned with the at least one elongated through opening of each of the first part and the second part.

14. The shoe sole according to claim 13, wherein the first part includes a first elongated through opening, the second part includes a second elongated through opening, the first part further includes a third elongated through opening, the second part further includes a fourth elongated through opening.

15. The shoe sole according to claim 1 wherein the cleat engagement part includes at least two attachment openings.

16. The shoe sole according to claim 1, further comprising a second sole layer at least partly overlapping the first sole layer, wherein the first sole layer has a first flexibility, and the second sole layer has a second flexibility that is more flexible than the first flexibility.

17. The shoe sole according to claim 1, further comprising a second sole layer at least partly overlapping the first sole layer, wherein the first sole layer includes a first material, and the second sole layer includes a second material different from the first material.

18. The shoe sole according to claim 17, wherein the first material includes a plastic material.

19. The shoe sole according to claim 17, wherein the second material includes an elastic material.

20. A shoe comprising the shoe sole according to claim 1, further comprising an upper attached to the shoe sole.

21. A shoe sole comprising:

a first sole layer including a first region having a first rigidity, and a second region having a second rigidity that is more flexible than the first rigidity and extending in a longitudinal direction of the shoe sole, the first sole layer having an inner side edge and an outer side edge; wherein the second region is spaced from a toe edge of the first sole layer and is spaced from a heel edge of the first sole layer, inner and outer side edges extending between the toe edge and the heel edge to define a periphery of the first shoe layer, the first sole layer has a cleat engagement part, the cleat engagement part having at least two attachment openings, the at least two attachment openings including a toe end and a heel end, the first sole layer further having at least one through opening disposed adjacent to the cleat engagement part and at least one of the inner and outer side edges, the toe end and the heel end of the at least two attachment openings overlapping the at least one through opening in a lateral direction of the shoe sole that is perpendicular to the longitudinal direction.

* * * * *